US007628642B2

(12) United States Patent
Chen et al.

(10) Patent No.: US 7,628,642 B2
(45) Date of Patent: Dec. 8, 2009

(54) ELECTRICAL CONNECTOR WITH ACTUATOR

(75) Inventors: Hsin-Lien Chen, Tu-cheng (TW); Chia-Pin Liu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 217 days.

(21) Appl. No.: 11/977,144

(22) Filed: Oct. 23, 2007

(65) Prior Publication Data

US 2008/0096431 A1 Apr. 24, 2008

(30) Foreign Application Priority Data

Oct. 23, 2006 (TW) ..... 95218687 U

(51) Int. Cl.
*H01R 12/24* (2006.01)

(52) U.S. Cl. ..... 439/495; 439/260; 439/329

(58) Field of Classification Search ..... 439/495, 439/260, 329
See application file for complete search history.

(56) References Cited

U.S. PATENT DOCUMENTS 7,147,498 B1 * 12/2006 Gillespie et al. ..... 439/260
2004/0180572 A1 * 9/2004 Chiu ..... 439/495
2005/0260885 A1 * 11/2005 Lu ..... 439/495
2006/0292910 A1 * 12/2006 Lee et al. ..... 439/260

FOREIGN PATENT DOCUMENTS

JP 2004-63401 A 2/2004

* cited by examiner

*Primary Examiner*—Hien Vu
(74) *Attorney, Agent, or Firm*—Andrew C. Cheng; Wei Te Chung; Ming Chieh Chang

(57) ABSTRACT

An electrical connector for an FPC includes an insulative housing (1) defining a space (11) and a pair of engage surfaces (141) at opposite sides of the space; a plurality of terminals (2, 3) side-by-side arranged in the housing and each comprising a supporting arm with a curved portion (212, 312) thereof; and an actuator (4) rotatable assembled in the space of the housing defining shafts (43) being received in the curved portions and a pair of end posts (44) respectively extending from two longitudinal ends thereof, each end post defines a project portion (441); the project portions are engage with the engage surfaces to stop the actuator from moving off while the actuator is rotated relative to the housing.

3 Claims, 6 Drawing Sheets

ELECTRICAL CONNECTOR WITH ACTUATOR

BACKGROUND OF THE INVENTION

1. Field of the Invention

The present invention relates to an electrical connector, and more particularly to an electrical connector with an actuator for a sheet-like connection member such as a flexible printed circuit or cable (FPC), a flexible flat cable (FFC) and so forth. All of these cables and circuit will be generally referred to as "FPC" for simplification.

2. Description of Related Art

Japanese Unexamined Patent No. 2004-63401 discloses a conventional electrical connector for flexible printed circuit (FPC). The connector includes an insulative housing, and an actuator pivotably assembled on the housing. The housing defines an FPC receiving cavity at one side and a pair of latches at the opposite end of the cavity. The actuator has a ⊏-shaped latch at each end thereof. The actuator moves forward horizontally, to be inserted the PFC and then rotate the actuator relative to the cavity, finally push the actuator rearward at the same time so that the ⊏-shaped latch lock the latch to ensure the actuator retain in the cavity.

However, the connection relationship of this kind of FPC connector is not reliable enough because any unmeant drag or pull incautiously exerted on the actuator may cause the actuator to be off the housing.

Hence, an improved electrical connector is desired to overcome above problem.

SUMMARY OF THE INVENTION

An object of the present invention is to provide an electrical connector of which the actuator can be hold steadily.

In order to achieve above-mentioned object, an electrical connector for an FPC includes an insulative housing defining a space and a pair of engage surfaces at opposite sides of the space; a plurality of terminals side-by-side arranged in the housing and each comprising a supporting arm with a curved portion thereof; and an actuator rotatable assembled in the space of the housing defining shafts being received in the curved portions and a pair of end posts respectively extending from two longitudinal ends thereof, each end post defines a project portion; the project portions are engage with the engage surfaces to stop the actuator from moving off while the actuator is rotated relative to the housing.

Other objects, advantages and novel features of the present invention will become more apparent from the following detailed description of the present embodiment when taken in conjunction with the accompanying drawings.

BRIEF DESCRIPTION OF THE DRAWINGS

FIGS. 7, 8 and 9 are cross-sectional views of FIG. 2 taken along line 7-7 showing the state of end posts and engage surfaces, wherein FIG. 7 shows the actuator at the opening position, FIG. 9 shows the actuator at a closed position, FIG. 8 shows the actuator between the opening position and the closed position.

DETAILED DESCRIPTION OF THE INVENTION

Figure 1:
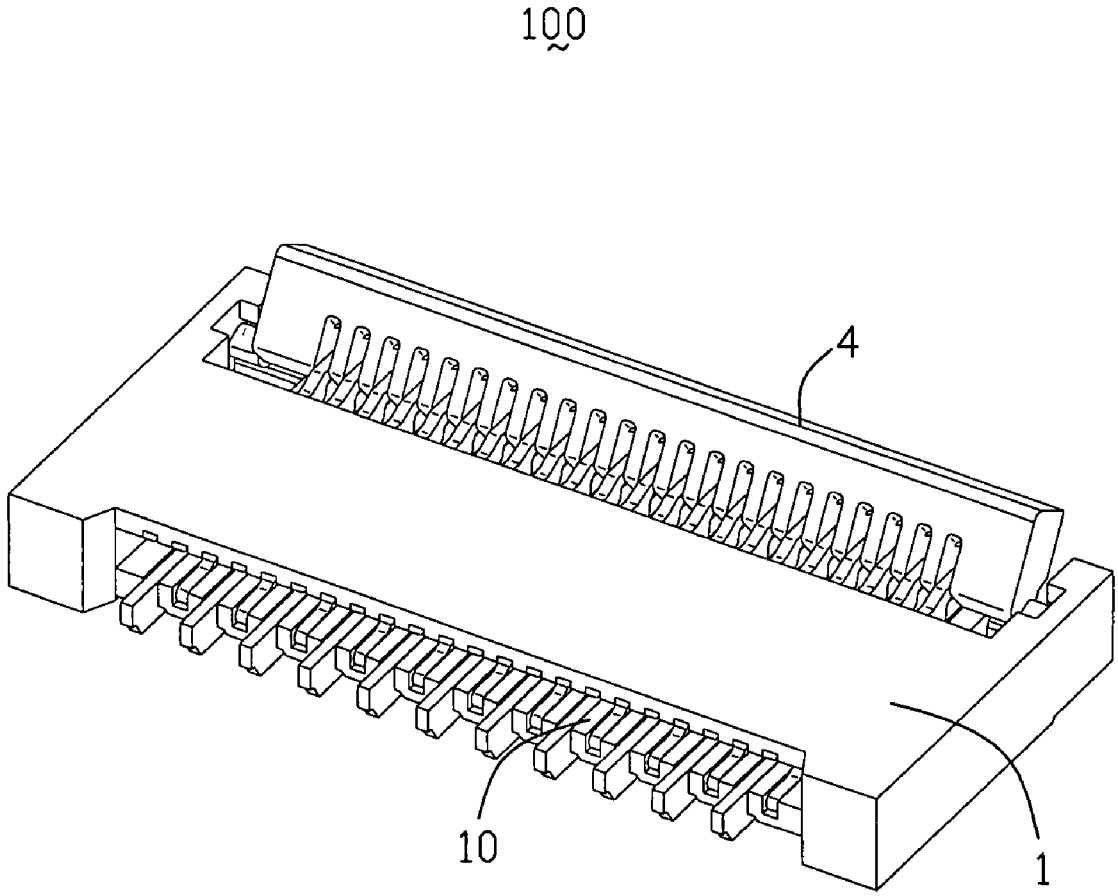
FIG. 1 is a front assembled perspective view of an electrical connector in accordance with the present invention.
Figure 2:
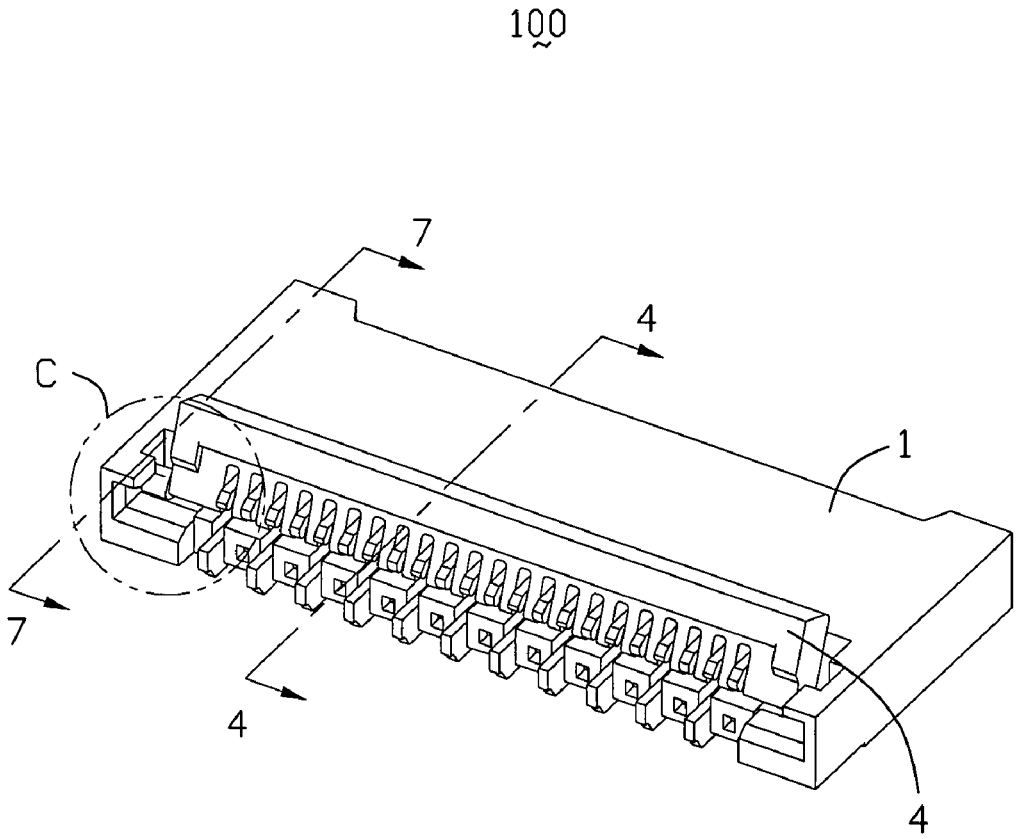
FIG. 2 is a rear assembled perspective view of the electrical connector of FIG. 1.

Reference will now be made to the drawing figures to describe the preferred embodiment of the present invention in detail.

Figure 3:
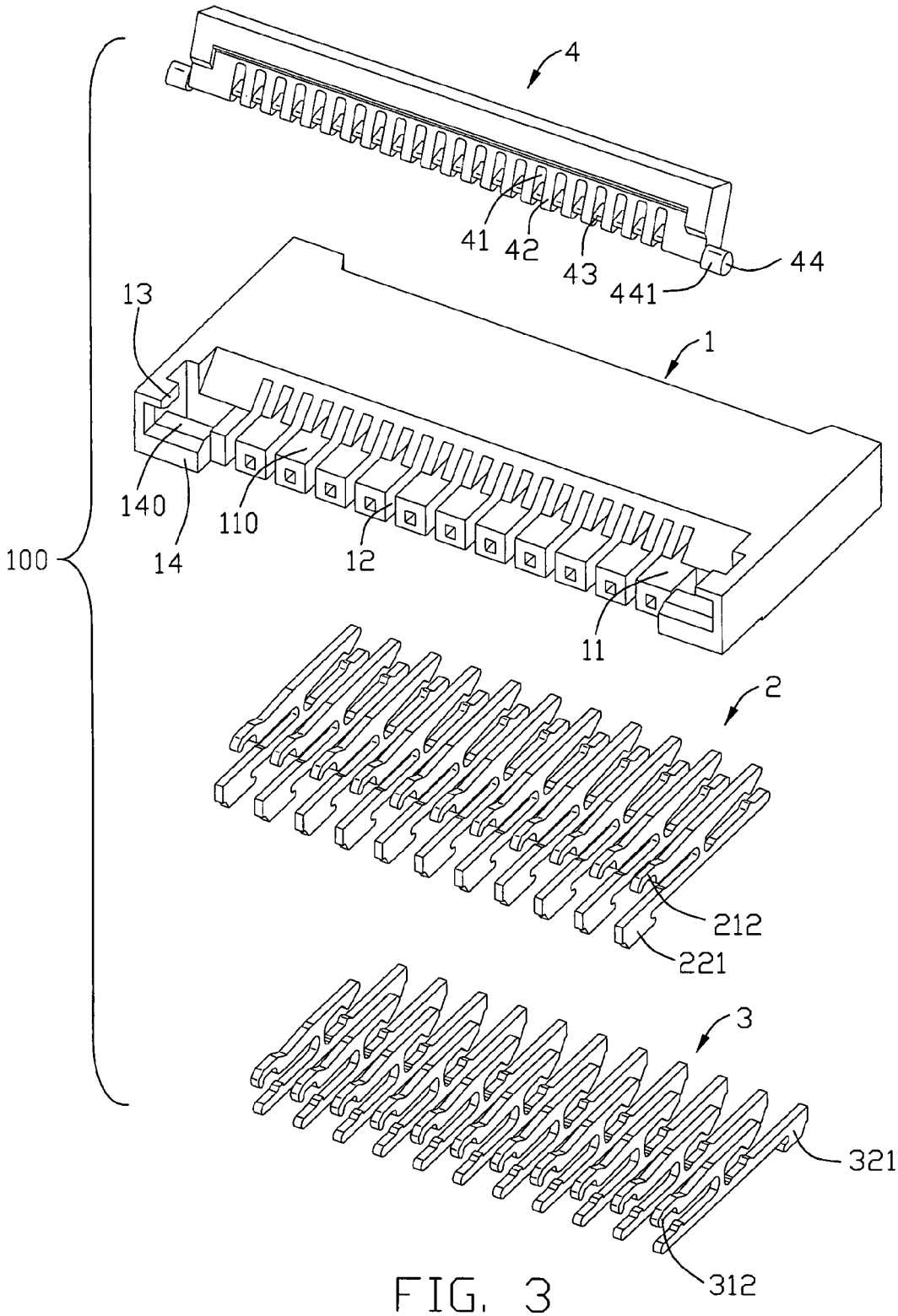
FIG. 3 is an exploded perspective view of the electrical connector of FIG. 2.
Figure 5:
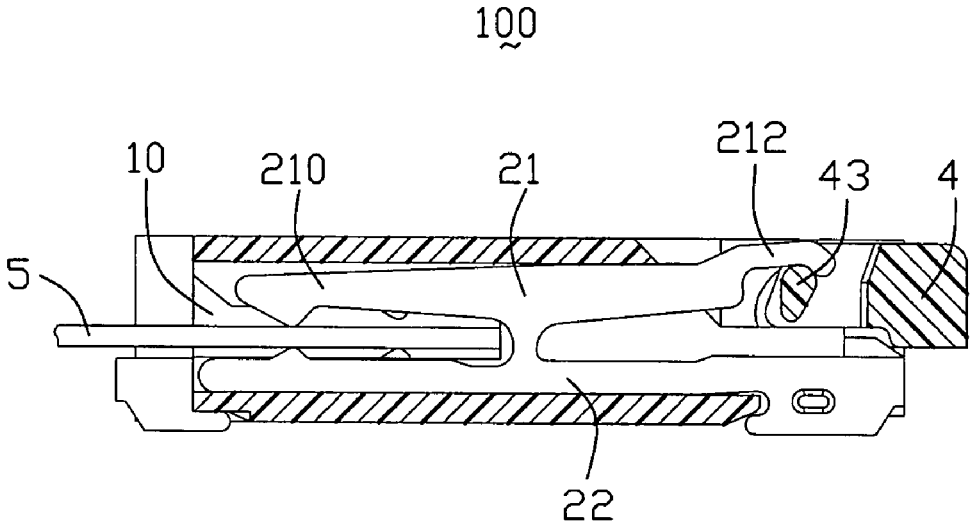
FIG. 5 is a cross-sectional view similar to FIG. 4, wherein the actuator is rotated to a closed position with an FPC.

Referring to FIG. 3, an electrical connector 100 in accordance with the present invention comprises a plurality of inverted H-shaped terminals of two types, first terminals 2 and second terminals 3, an actuator 4 pivotally moving to urge the terminals 2, 3 to connect with an FPC 5 as FIG. 5 shown, and an insulative housing 1 holding the terminals 2, 3 and the actuator 4. The insulative housing 1 is of an elongated shape and defines a receiving cavity 10 at a front portion thereof as shown in FIG. 1. A rear portion opposite to the front portion of the housing defines a space 11 opened upward and rearward. The bottom surface of the space 11 is defined as a supporting surface 110. A plurality of receiving grooves 12 arranged along the elongate direction of the insulative housing 1, run through the front face and the back face of the housing.

As shown in FIG. 3, the first terminals 2 are inserted into the housing 1 from the rear portion of the housing, the second terminals 3 are from the front portion of the housing, so as to the two type terminals are alternatively arranged in the insulative housing 1. The two type terminals are similar and each mainly composes of two parallel cantilevered arms and a fulcrum portion joined the two arms at the middle portion of the arm, which will be described hereafter, and the first terminals 2 will be described in detail for simplification.

Figure 4:
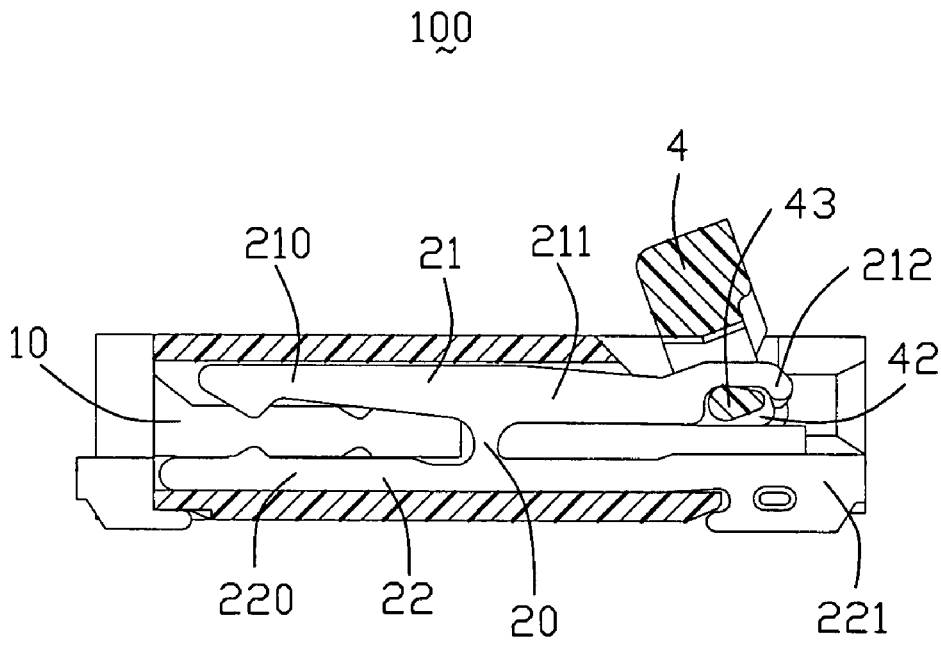
FIG. 4 is a cross-sectional view of FIG. 2 taken along line 4-4, wherein the actuator is placed at an opening position.

As shown in FIGS. 4 and 5, a upper and lower beams 210 and 220 at one side (left side) of the fulcrum portion 20 extend forward into the receiving cavity 10 and are designated as contacting arms, and each has a contact point at free ends thereof. A upper beam 211 at another side (right side) of the fulcrum portion 20 is extends to the rear portion of the housing 1 for assembly of the actuator and is designated as a supporting arm. The supporting arm 211 is provided with a curved portion 212. Corresponding, a lower beam extends also to the rear potion of the housing 1 and a solder portion 221 is formed at the free end thereof and out of the housing. Differently, the solder portion 321 of the second terminal 3 is at the free end of lower contacting arm since the second terminal 3 is inserted into the housing from another opposite direction to the first terminal 2.

Referring to FIG. 3, the actuator 4 is formed with an elongated plate. One side edge of the actuator 4 defines a plurality of parallel slots 41. Between adjacent slots 41 are ribs 42, cam shaped shafts 43 are formed in the slots 41. The actuator 4 is assembled on the insulative housing 1 by the cam shaped shafts 43 engaging with the inside of the curved portion 212, 312 of the supporting arms 21, 31 of the terminals 2, 3. As shown in FIG. 4, the actuator 4 is in the opening position, the ribs 42 supported by the supporting surface 110, and the longer axis of the cam shaped shafts 43 are parallel to the beams of the terminal 2. As FIG. 5 shown, after the FPC 5 is inserted into the receiving cavity 10, the actuator 4 rotates to the supporting surface 110, the longer axis of the shaft moves vertical to the beams and pushes the curved portion 212 upwards, this action makes the contacting arms 210 move downwards relative to the fulcrum portion 20 to connect the FPC 5, and then the actuator 4 is closed.

Figure 6:
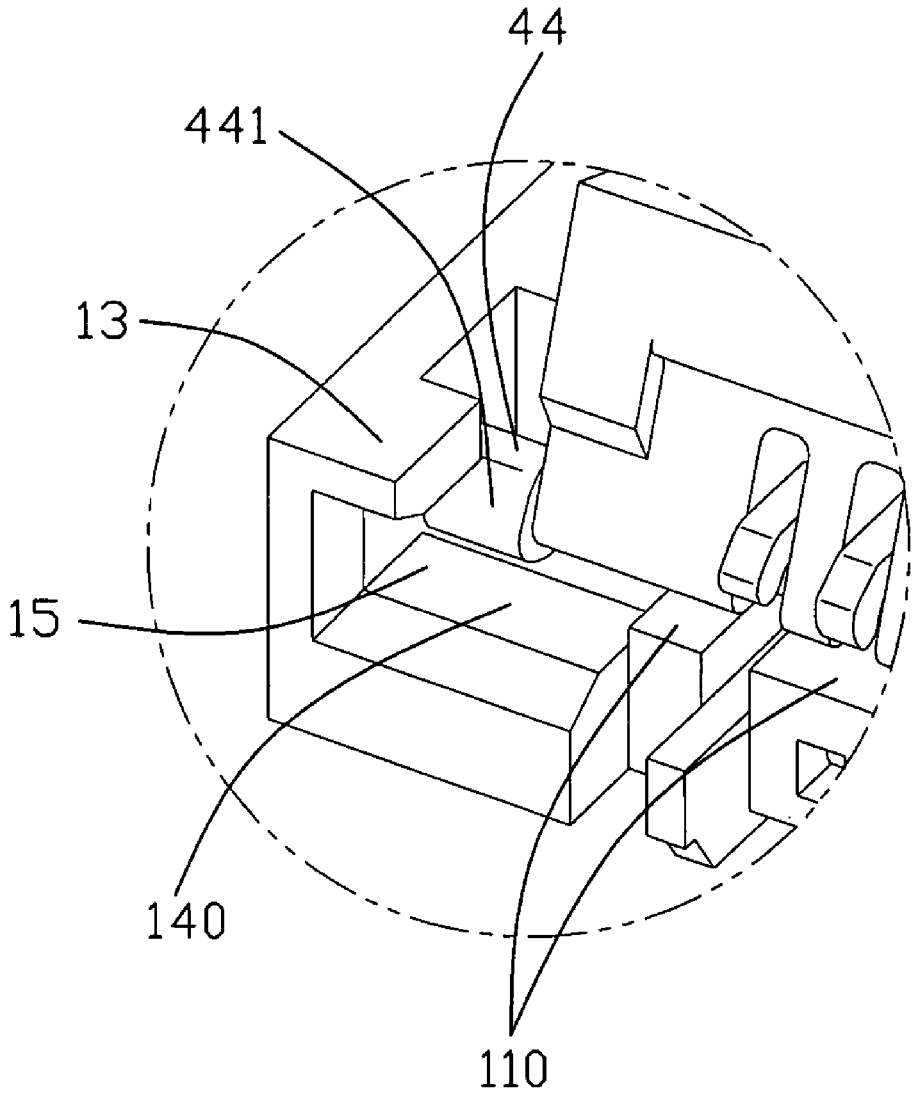
FIG. 6 is a large perspective view of a part C shown in FIG. 2.

As shown in FIGS. 3 and 6, a block portion 14 is provided between the supporting surface 110 and the end side of the housing 1. The block portion 14 has a top surface 140 somewhat below the supporting surface 110. A stopper portion 13 extends inward from the top end side of the housing and over the block portion 14, and a passageway 15 formed between the stopper portion 13 and the block portion 14. The actuator 4 has a pair of end posts 44 respectively extending from two longitudinal ends thereof to be received in a room defined by the block portion 14 and stopper portion 13 through the passageway, the stopper portion 13 can prevent the actuator 4 from moving off the room. FIG. 6 shows a part of the end posts 44 engaging with the insulative housing 1 when the actuator 4 is assembled on the insulative housing 1. The two end posts 44 are gibbous with a project portion 441 extending along the direction vertical to the axes of end posts 44 in the periphery thereof, which will be described in detail hereafter.

Figure 7:
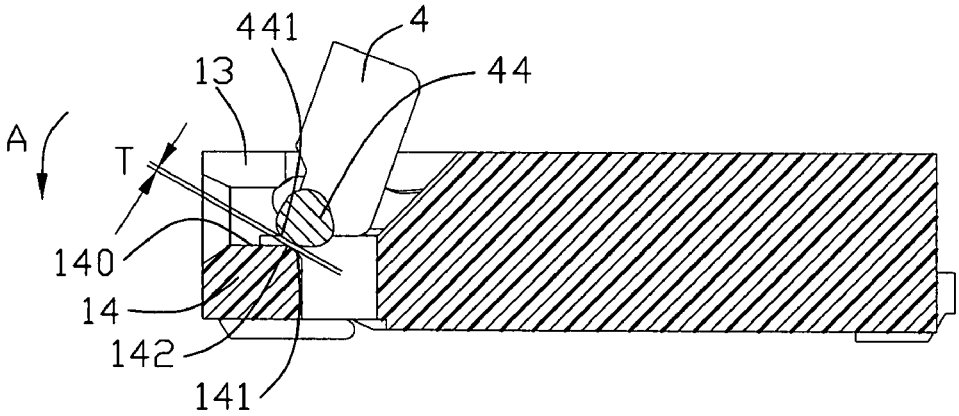
Figure 8:
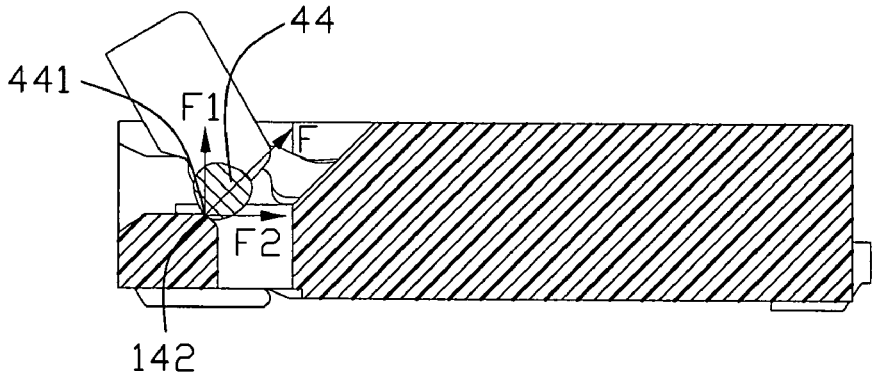
Figure 9:
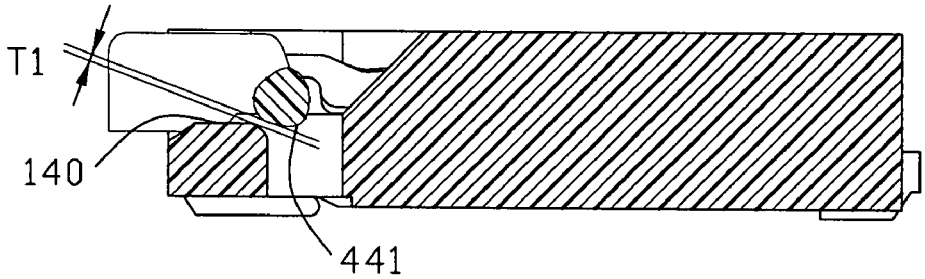

FIGS. 7, 8 and 9 shows the process of the two end posts 44 engaging with the insulative housing 1 while the actuator 4 rotates from the opening position to the closed position. As the best shown in FIG. 7, the block portion 14 defines an engage surface 141 at the inner top corner thereof and slant downward, an in section 142 of the top surface 140 and the engage surface 141 is nearest to the end posts 44. A distance T is between the end posts 44 and the engage surface 141 when the actuator 4 is open. The end posts 44 rotates relative to the housing along arrow A when the actuator 4 is forced to move, until the project portion 441 encounters the engage surface 141 as shown in FIG. 8. The project portion 441 jundieds the engage surface 141 and generate a force as arrow F shown. The force F can be disassembled as a vertical force $F_1$ and a horizontal $F_2$ relative to the top surface 140 of the block portion 14, the force $F_2$ can prevent the actuator 4 from moving along the direction opposite to the force and even moving off, so that the supporting arms can be made without the curved portions 212, 312. After the actuator 4 is closed, another distance $T_1$ is formed between the engage surface 141 and the end posts 44. We can also make the actuator 4 rotated upwards to let the FPC 5 out. What's more, the engage surface 141 may engage with the project portion 441 to stop the actuator 4 from opening when unmeant drag or pull incautiously exerted on the actuator 4 in the closed position.

However, the disclosure is illustrative only, changes may be made in detail, especially in matter of shape, size, and arrangement of parts within the principles of the invention.

What is claimed is:

1. An electrical connector for an FPC (Flexible Printed Circuit), comprising: an insulative housing defining a space for receiving the FPC and having a stopper portion and a block portion at each end thereof that has a pair of engage surfaces at opposite sides of the space;

a plurality of terminals side-by-side arranged in the housing, and comprising a supporting arm with a curved portion thereof; and an actuator rotatable assembled in the space of the housing, comprising shafts being received in the curved portions and a pair of end posts respectively extending from two longitudinal ends thereof, each end post defines a project portion;

wherein the project portions engages with the engage surfaces to stop the actuator from moving off while the actuator is rotated relative to the housing;

wherein each project portion extends outwardly in a direction vertical to an axis of the end posts;

wherein each of the block portions with a top surface is provided at side of the space and the top surface slants inward and downward to form said engage surface;

wherein the engage surface is at the inner comer of the block portion;

wherein the top surface is below a bottom face of the space;

wherein each of the stopper portions is defined by extending inward from a side wall of the housing and over the block portion, a passageway for an insertion of the end posts is defined between the block portion and stopper portion; and wherein the insulative housing defines a receiving cavity opposite to the space, a plurality of receiving grooves to receive the terminals are defined by running through the receiving cavity and the space.

2. The electrical connector as described in claim 1, wherein the end posts of the actuator are not retained in sidewalls of the housing.

3. The electrical connector as described in claim 1, wherein the shaft is cam shaped and received in the curved portion.

* * * * *